US006827320B2

(12) United States Patent
Yeh

(10) Patent No.: US 6,827,320 B2
(45) Date of Patent: Dec. 7, 2004

(54) TRACK ASSEMBLY HAVING SOLIDLY SECURED BRACKETS

(76) Inventor: Jurry Yeh, P.O. Box 63-298, Taichung (TW), 406

( * ) Notice: Subject to any disclaimer, the term of this patent is extended or adjusted under 35 U.S.C. 154(b) by 39 days.

(21) Appl. No.: 10/367,434

(22) Filed: Feb. 10, 2003

(65) Prior Publication Data

US 2004/0155161 A1 Aug. 12, 2004

(51) Int. Cl.[7] ..... A47B 96/06
(52) U.S. Cl. ..... 248/220.22; 248/245
(58) Field of Search ..... 248/245, 220.22, 248/244, 231.41, 224.51, 224.61, 297.21, 297.31, 243; 211/134, 187, 153; 411/84, 85, 104, 393

(56) References Cited

U.S. PATENT DOCUMENTS 2,676,680 A * 4/1954 Kindorf ..... 403/22
3,917,385 A * 11/1975 Caswell ..... 359/822
4,597,553 A * 7/1986 Rorabaugh ..... 248/440
4,895,331 A * 1/1990 Nehls ..... 248/245
4,899,793 A * 2/1990 Snyder et al. ..... 142/7
5,154,385 A * 10/1992 Lindberg et al. ..... 248/225.11
5,201,487 A * 4/1993 Epplett ..... 248/298.1
5,364,052 A * 11/1994 De Gruttis ..... 248/245
5,421,551 A * 6/1995 LeClaire ..... 248/257
5,584,462 A * 12/1996 Reese ..... 248/477
6,003,825 A * 12/1999 Abernathy, Jr. ..... 248/478
6,086,300 A * 7/2000 Frohlich ..... 411/84
6,105,794 A * 8/2000 Bauer ..... 211/94.01
6,540,093 B1 * 4/2003 Shumway ..... 211/90.02
6,666,425 B1 * 12/2003 Ferguson ..... 248/477
2003/0150829 A1 * 8/2003 Linden et al. ..... 211/126.1
2003/0198530 A1 * 10/2003 Hoffmann et al. ..... 411/84
2003/0206785 A1 * 11/2003 Hoffmann et al. ..... 411/84

FOREIGN PATENT DOCUMENTS

GB 2050549 A * 1/1981 ..... F16B/37/04

* cited by examiner

*Primary Examiner*—Leslie A. Braun
*Assistant Examiner*—A. Joseph Wujciak

(57) ABSTRACT

A track device includes a track member having a longitudinal channel and a longitudinal opening communicated with each other, and one or more longitudinal juts extended into the longitudinal channel of the track member. One or more brackets are slidably received in the longitudinal channel of the track member and include a number of teeth. One or more fasteners may force the bracket against the track member, to force and to engage the teeth of the bracket onto the longitudinal juts, and to adjustably secure the bracket to the track member, and thus to adjustably support various objects to the track member.

5 Claims, 5 Drawing Sheets

TRACK ASSEMBLY HAVING SOLIDLY SECURED BRACKETS

BACKGROUND OF THE INVENTION

1. Field of the Invention

The present invention relates to a track assembly, and more particularly to a track assembly having one or more brackets to be adjustably and solidly secured thereto.

2. Description of the Prior Art

Typical furniture or frames or cabinets or shelves or the like may comprise a shelf body including one or more fasteners secured to two sidewalls thereof, to stably support one or more shelf panels between the sidewalls thereof. However, the fasteners may not be adjusted up and down relative to the shelf body, such that the shelf panels also may not be easily adjusted relative to the shelf body to different heights.

For example, when the objects to be received or supported on the shelf panels include different heights, the shelf panels may not be adjusted up and down relative to the sidewalls of the cabinets or shelves, such that the objects may not be suitably or snugly received or supported in the cabinets or shelves.

Similarly, the typical book shelves, the typical cabinets or the like comprise one or more door panels pivotally secured to the cabinet body with a number of fasteners. However, the fasteners also may not be easily adjusted relative to the cabinet body to different heights, such that the door panels also may not be easily adjusted relative to the cabinet body to different heights, and thus may not be suitably and pivotally attached to the cabinet body. Sometimes, the fasteners are required to be engaged into and disengaged from the cabinet body several times, before the door panels may be suitably attached or secured to the cabinet body.

The present invention has arisen to mitigate and/or obviate the afore-described disadvantages of the conventional furniture or shelves or cabinets.

SUMMARY OF THE INVENTION

The primary objective of the present invention is to provide a track assembly having one or more brackets to be adjustably and solidly secured thereto, in order to adjustably support various objects on the track assembly.

In accordance with one aspect of the invention, there is provided a track assembly comprising a track member including a longitudinal channel formed therein, and at least one longitudinal jut extended into the longitudinal channel thereof, a bracket slidably received in the longitudinal channel of the track member, and including a plurality of teeth formed thereon, and facing toward the longitudinal jut of the track member, and to be forced and engaged onto the longitudinal jut of the track member, and means for forcing the bracket against the track member, to force the teeth of the bracket to engage onto the longitudinal jut of the track member, and to adjustably secure the bracket to the track member, and to prevent the bracket from being moved relative to the track member. The bracket may thus be solidly and adjustably secured to the track member, and may be prevented from being moved relative to the track member, in order to adjustably and solidly support various objects to the track member.

The bracket includes a screw hole formed therein, the forcing means includes a fastener threaded with the screw hole of the bracket, and engageable with the track member.

The track member includes a longitudinal depression formed therein, the fastener includes a tip engaged into the longitudinal depression of the track member.

The bracket includes a bar extended therefrom, and a flap extended from the bar, the teeth are formed on the flap of the bracket.

A casing may further be provided and secured to the bracket, the casing includes a recess formed therein, and a shelf member may further be provided and engaged into the recess of the casing and so as to be secured to the casing. One or more fasteners may further be provided and engaged through the casing and engaged with the shelf member, to further solidly secure the shelf member to the casing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
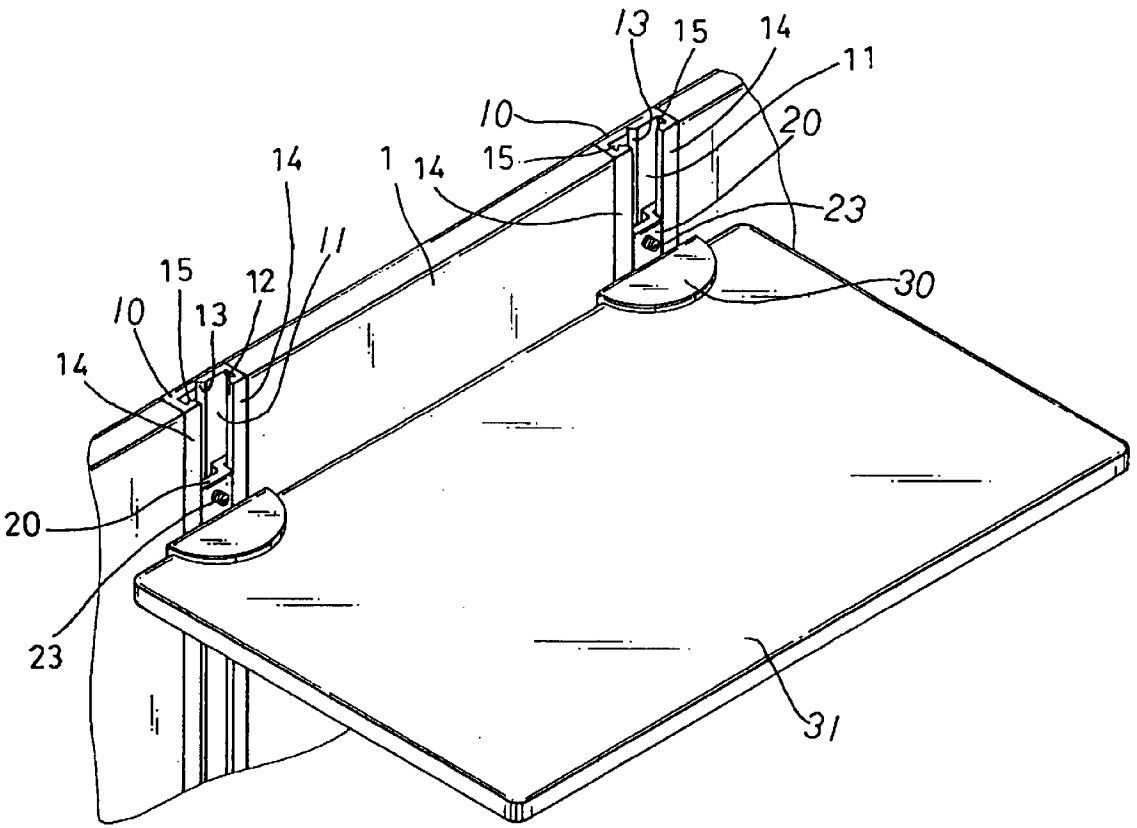
FIG. 1 is a partial perspective view of a track assembly in accordance with the present invention.
Figure 2:
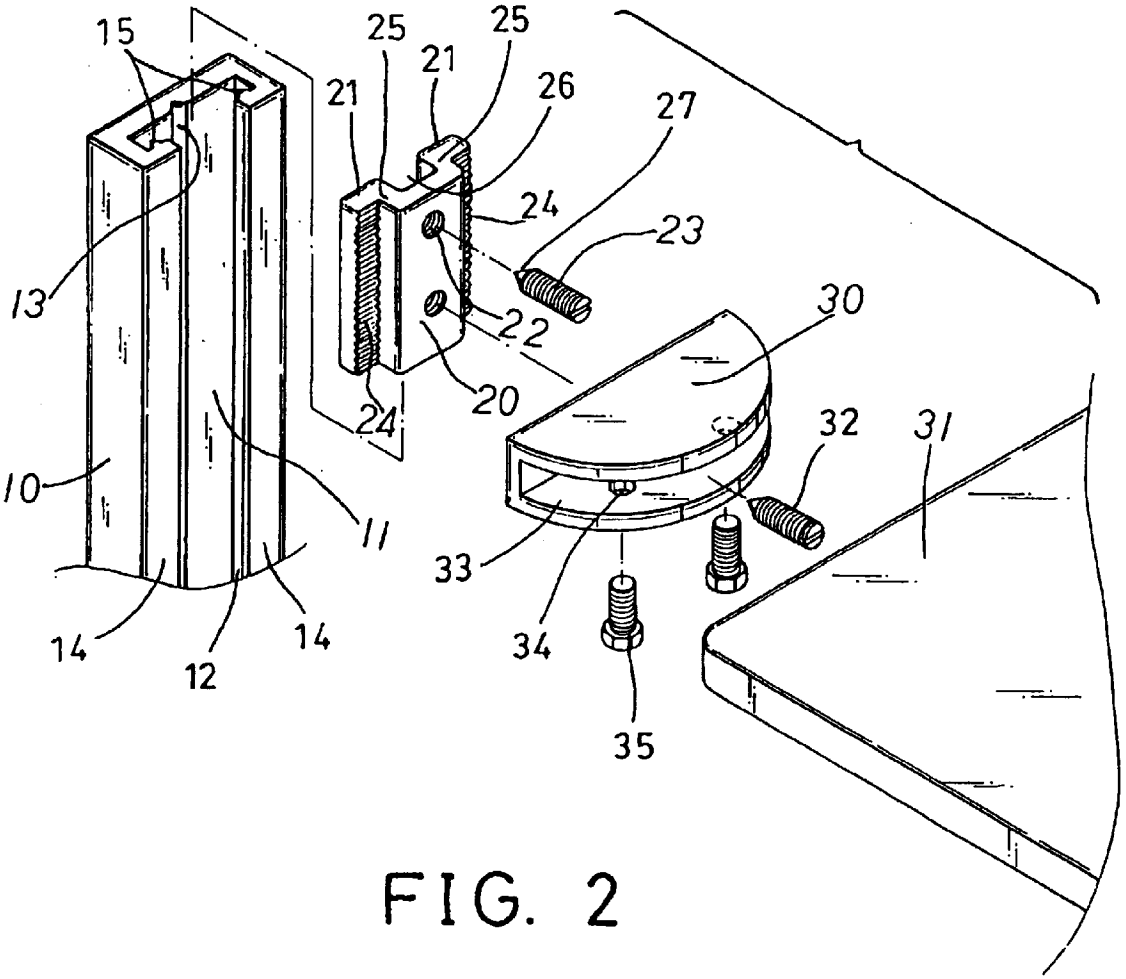
FIG. 2 is a partial exploded view of the track assembly.
Figure 3:
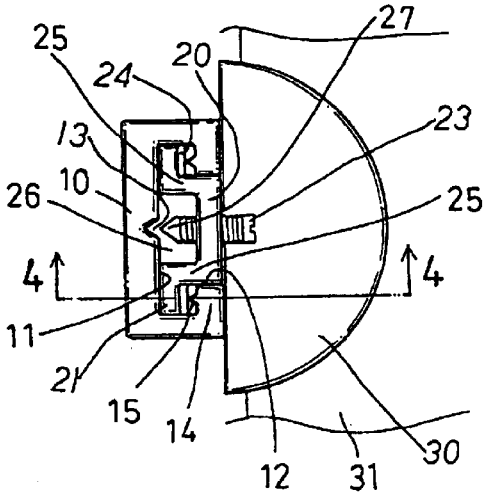
FIG. 3 is a partial top plan view of the track assembly.
Figure 4:
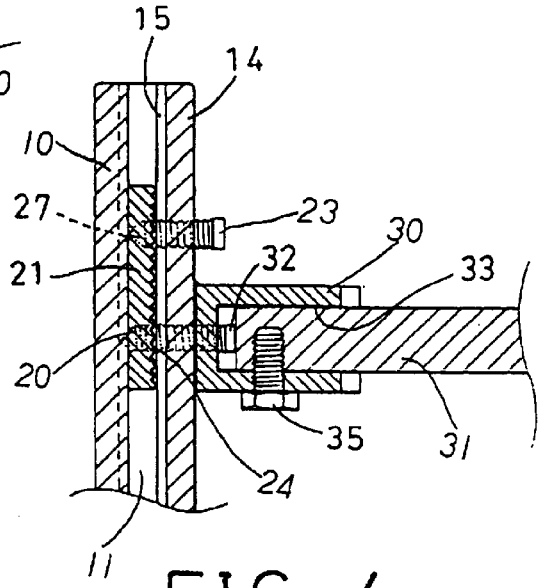
FIG. 4 is a partial cross sectional view taken along lines 4—4 of FIG. 3.

Referring to the drawings, and initially to FIGS. 1–4, a track assembly in accordance with the present invention comprises a support body 1, such as a plate, a housing, a cabinet or a shelf or the like, one or more track members 10 engaged or secured or attached to the support body 1, and one or more brackets 20 slidably received in the track members 10 respectively, and adjustably secured to the track members 10 at any selected heights or positions, for adjustably supporting one or more shelf members 31 to the track members 10 at any selected heights or positions.

The track members 10 each may include a longitudinal channel 11 formed therein, a longitudinal opening 12 formed in one side thereof and formed or defined by a pair of opposite and longitudinal flanges 14, and communicating with the longitudinal channel 11 thereof, in order to form a T-shaped longitudinal passage together with the longitudinal channel 11 thereof.

The track members 10 each may include a longitudinal depression 13 formed therein, such as formed in the middle portion thereof and communicating with the longitudinal channel 11 thereof. The track members 10 each may further include one or more, such as two longitudinal juts 15 extended into the longitudinal channel 11 thereof, such as extended from the longitudinal flanges 14 respectively.

The brackets 20 are slidably received in the T-shaped longitudinal passages of the track members 10 respectively, and to be slid or moved and adjusted along the respective track members 10. For example, the brackets 20 each may include a pair of bars 25 extended therefrom, and perpendicular to the bracket 20, and slidably received in the longitudinal opening 12 of the respective track members 10, so as to form or define a longitudinal groove 26 between the bars 25.

The brackets 20 each may further include a pair of flaps 21 extended from the respective bars 25 and perpendicular to the bars 25 respectively, and slidably received in the longitudinal channel 11 of the respective track members 10. The flaps 21 each may include a serrated surface or a number of teeth 24 formed thereon, and facing toward the longitudinal juts 15 of the track members 10 respectively, and to be forced and engaged onto the longitudinal juts 15 of the track members 10 respectively.

The brackets 20 each may further include one or more screw holes 22 formed therein, and communicating with the longitudinal groove 26 thereof. A fastener 23 may be engaged with one of the screw holes 22 of the bracket 20, and threaded or moved relative to the bracket 20, and preferably aligned with the longitudinal depression 13 of the track member 10, best shown in FIGS. 3, 4, and may include a tip 27 to be engaged into the longitudinal depression 13 of the track member 10.

Figure 5:
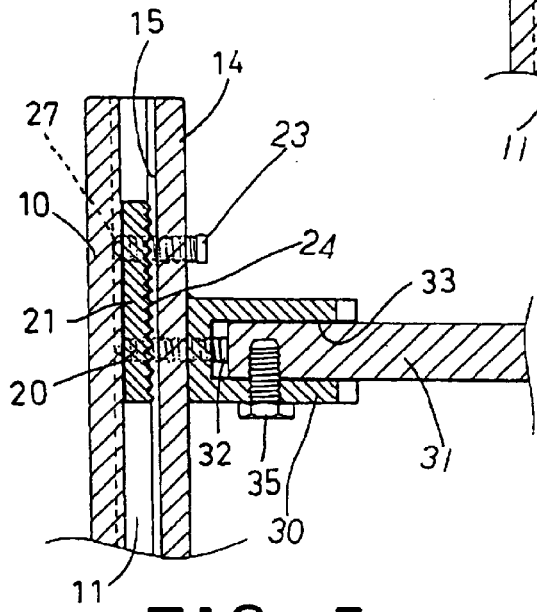
FIG. 5 is a partial cross sectional view similar to FIG. 4, illustrating the operation of the track assembly.

As shown in FIG. 5, when the fastener 23 is further threaded or moved relative to the bracket 20, and forced against the track member 10, the flaps 21 of the brackets 20 may be forced toward or against the longitudinal flanges 14 of the track members 10 respectively, and the teeth 24 of the flaps 21 of the brackets 20 may be forced against the longitudinal juts 15 of the track members 10 respectively, and may be engaged onto or into the longitudinal juts 15 of the track members 10 respectively, so as to solidly and adjustably secure the brackets 20 to the track members 10 at the selected or required positions.

It is preferable that the longitudinal juts 15 and/or the track members 10 are made of aluminum materials, or the other softer materials, and the brackets 20 are made of metal materials, or the other stronger materials, for allowing the teeth 24 of the flaps 21 to be engaged into the longitudinal juts 15 of the track members 10 respectively, when the flaps 21 of the brackets 20 are forced against the longitudinal flanges 14 of the track members 10 respectively by the fastener 23.

A casing 30 may be secured to each of the brackets 20 with another fastener 32 which may be threaded with the other screw hole 22 of the bracket 20, in order to secure the casing 30 to the bracket 20. The casing 30 includes a recess 33 formed therein to receive the shelf members 31, and thus to secure or support the shelf members 31 to the track members 10. One or more fasteners 35 may further be provided and engaged through holes 34 of the casing 30, and engaged with or into the shelf member 31, so as to further solidly secure the shelf member 31 to the casing 30.

In operation, the brackets 20 may be adjusted along the track members 10 respectively to the selected or required positions, and may then be secured to the track members 10 respectively with the fasteners 23, at the selected or required positions. The shelf member 31 may then be solidly secured to the brackets 20 with the casings 30, such that the shelf member 31 may also be secured to the track members 10 respectively at the selected or required positions.

It is to be noted that the engagement of the teeth 24 of the flaps 21 into the longitudinal juts 15 of the track members 10 respectively may solidly secure and position the flaps 21 of the brackets 20 to the longitudinal flanges 14 of the track members 10 respectively, and may prevent the brackets 20 from moving up and down relative to the track members 10.

Figure 6:
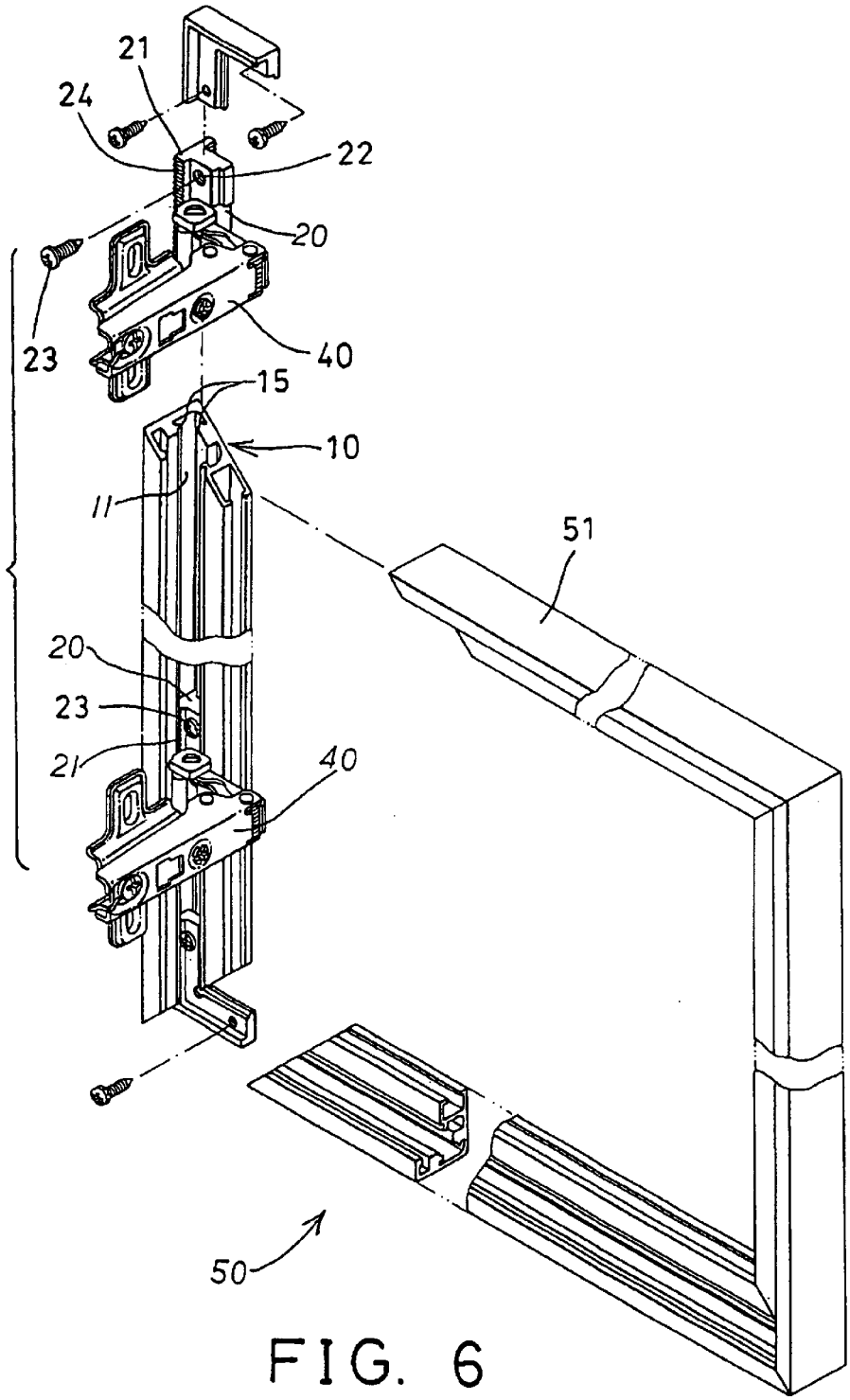
FIG. 6 is a partial exploded view of a door frame including a track assembly in accordance with the present invention provided therein.
Figures 7, 8:
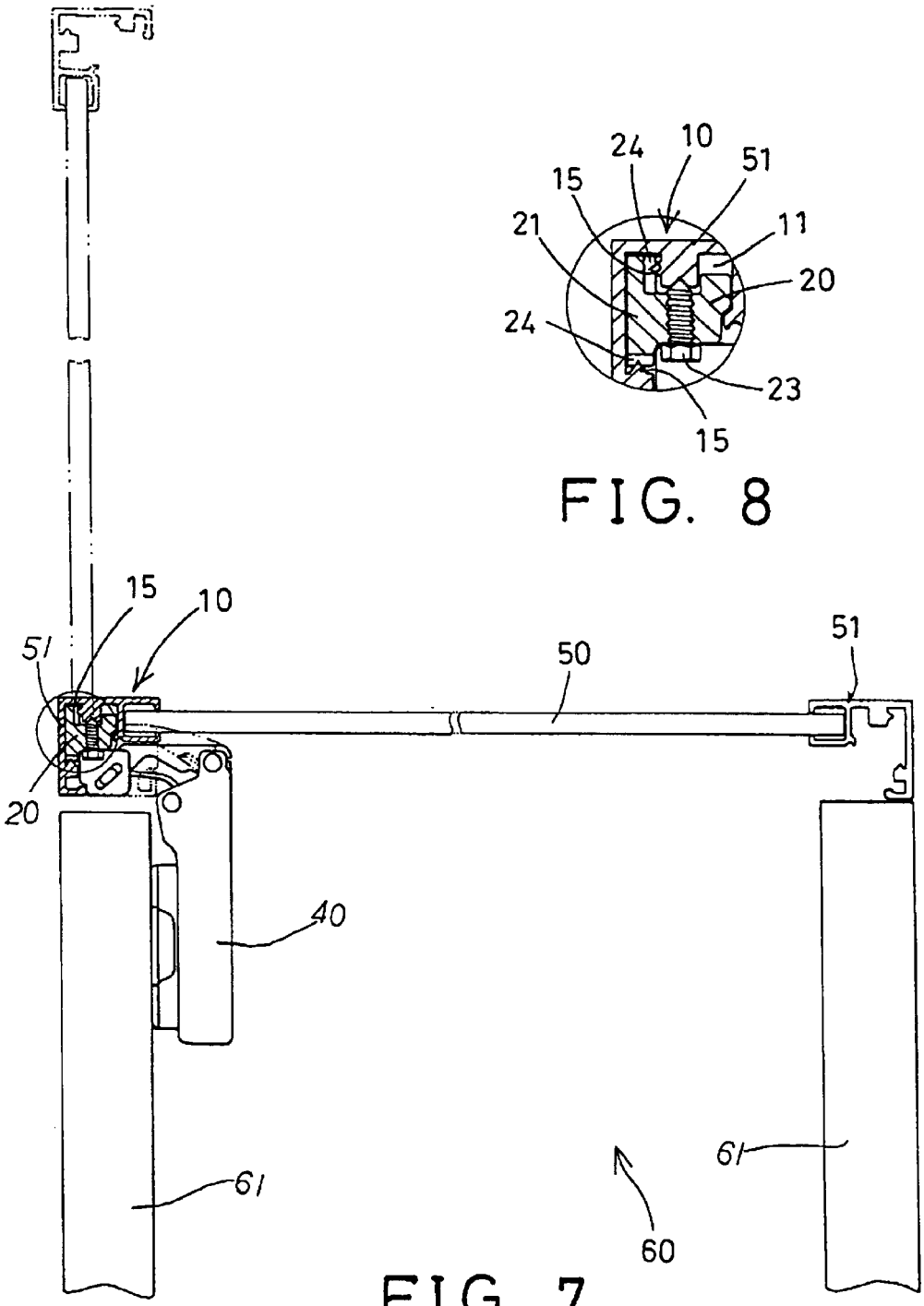
FIG. 7 is a partial upper plan view of the door frame as shown in FIG. 6, in which a portion of the track assembly is cut off to show the inner structure of the track assembly.
FIG. 8 is an enlarged partial cross sectional view of the track assembly as shown in FIG. 7.

Alternatively, as shown in FIGS. 6–8, the track member 10 may be formed or provided in the other support body, such as provided in a door frame 51 of a door 50 for a cabinet 60 or the like. The track member 10 may also include a longitudinal channel 11 formed therein to slidably receive one or more brackets 20 therein, and one or more longitudinal juts 15 extended into the longitudinal channel 11 thereof. The brackets 20 may also include one or more flaps 21 each having a serrated surface or a number of teeth 24 formed thereon, and facing toward the longitudinal juts 15, and to be forced and engaged onto the longitudinal juts 15 of the track member 10 respectively.

One or more fasteners 23 may be threaded with the respective screw holes 22 of the bracket 20, and engaged with the track member 10, best shown in FIG. 8, in order to force the teeth 24 to engage onto or into the longitudinal juts 15, and so as to adjustably and solidly secure the brackets 20 to the track member 10.

A pivot joint 40 may be secured to each of the brackets 20, and may also be secured to one of the side walls 61 of the cabinet 60, in order to pivotally or openably secure the door 50 to the cabinet 60. The brackets 20 and thus the pivot joints 40 may be adjusted and solidly secured to the track member 10 of the door frame 51 at the selected or required position, for allowing the door 50 to be adjustably secured to the cabinet 60 at the required or selected position.

Accordingly, the track assembly in accordance with the present invention includes one or more brackets to be adjustably and solidly secured thereto, in order to adjustably support various objects on the track assembly.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A track assembly comprising:

a track member including a longitudinal channel formed therein, and at least one longitudinal jut extended into said longitudinal channel thereof, a bracket slidably received in said longitudinal channel of said track member, and including a plurality of teeth formed thereon, and facing toward said at least one longitudinal jut of said track member, and to be forced and engaged onto said at least one longitudinal jut of said track member, a casing secured to said bracket, said casing including a recess formed therein, a shelf member engaged into said recess of said casing and secured to said casing, and means for forcing said bracket against said track member, to force said teeth of said bracket to engage onto said at least one longitudinal jut of said track member, and to adjustably secure said bracket to said track member, and to prevent said bracket from being moved relative to said track member.

2. The track assembly as claimed in claim 1, wherein said bracket includes a screw hole formed therein, said forcing means includes a fastener threaded with said screw hole of said bracket, and engageable with said track member.

3. The track assembly as claimed in claim 2, wherein said track member includes a longitudinal depression formed therein, said fastener includes a tip engaged into said longitudinal depression of said track member.

4. The track assembly as claimed in claim 2, wherein said bracket includes a bar extended therefrom, and a flap extended from said bar, said teeth are formed on said flap of said bracket.

5. The track assembly as claimed in claim 1 further comprising at least one fastener engaged through said casing and engaged with said shelf member, to solidly secure said shelf member to said casing.

* * * * *